United States Patent [19]

Sparks

[11] Patent Number: 4,886,398

[45] Date of Patent: Dec. 12, 1989

[54] SEA PLATFORMS FOR IMPROVING THEIR DYNAMIC BALANCE

[75] Inventor: Charles Sparks, Le Vesinet, France

[73] Assignee: Alsthom Atlantique Institut Francais du Petrole, Rueil Malmaison, France

[21] Appl. No.: 257,168

[22] Filed: Oct. 13, 1988

Related U.S. Application Data

[63] Continuation-in-part of Ser. No. 8,372, Jan. 29, 1987, abandoned, which is a continuation-in-part of Ser. No. 644,703, Aug. 27, 1984, abandoned.

[51] Int. Cl.[4] ..... B63B 35/44

[52] U.S. Cl. ..... 405/224; 114/264; 405/195

[58] Field of Search ..... 405/205, 206, 207, 208, 405/224, 225, 195; 114/265, 264, 121; 175/5-7

[56] References Cited

U.S. PATENT DOCUMENTS

| | | | |
|---|---|---|---|
| 1,511,153 | 10/1924 | Armstrong | 114/265 |
| 1,879,745 | 9/1932 | Henker | 114/265 |
| 2,777,669 | 1/1957 | Willis et al. | 114/265 X |
| 3,490,406 | 1/1970 | O'Reilly et al. | 405/207 X |
| 3,540,396 | 11/1970 | Horton | 114/265 |
| 3,673,974 | 7/1972 | Harper | 114/265 |
| 3,714,788 | 2/1973 | Mott | 405/204 |
| 3,874,314 | 4/1975 | Sanders | 114/265 |
| 4,065,935 | 1/1978 | Burrow et al. | 405/207 X |
| 4,102,288 | 7/1978 | Berry et al. | 114/264 X |
| 4,167,148 | 9/1979 | Fagren | 114/265 |
| 4,266,499 | 5/1981 | Tam | 405/224 X |
| 4,434,741 | 3/1984 | Wright et al. | 114/264 |
| 4,457,250 | 7/1984 | Oshima et al. | 114/265 |
| 4,556,008 | 12/1985 | Copson | 114/265 |

FOREIGN PATENT DOCUMENTS

| | | | |
|---|---|---|---|
| 2525176 | 10/1983 | France . | |
| 1065216 | 4/1967 | United Kingdom . | |
| 1277494 | 6/1972 | United Kingdom . | |
| 1277800 | 6/1972 | United Kingdom . | |
| 1303594 | 1/1973 | United Kingdom . | |
| 2110602 | 6/1983 | United Kingdom | 114/265 |
| 2112326 | 7/1983 | United Kingdom . | |
| 2118904 | 9/1983 | United Kingdom . | |

*Primary Examiner*—Dennis L. Taylor

*Attorney, Agent, or Firm*—Antonelli, Terry & Wands

[57] ABSTRACT

An improved platform comprising several columns at least partially submerged in service, wherein, over at least a submerged portion of at least one column, the section defined by the intersection of this portion with a horizontal plane decreases when the depth increases.

16 Claims, 2 Drawing Sheets

SEA PLATFORMS FOR IMPROVING THEIR DYNAMIC BALANCE

This application is a continuation of application Ser. No. 008,372, filed Jan. 29, 1987 which is a continuation of application Ser. No. 644,703, filed Aug. 27, 1984.

BACKGROUND OF THE INVENTION

The present invention relates to improvements to sea platforms for improving the balance of a platform comprising several at least partially submerged columns which are subjected to dynamic effects coming from the sea environment such, for example, as the swell, currents or wind.

In the prior art, such platforms, which are of the semi-submersible type with conventional anchorage or of the type with anchorage by taut lines, comprise columns formed from one or more cylinder portions.

In the case of a column formed of several cylinder portions of differing diameters, the cylinders of larger diameter are situated the deepest, so as to have the submerged volumes required for obtaining the desired buoyancy, while removing the volume from the influence of the swell, currents or winds.

Thus, in the prior art, the section obtained by the intersection of a horizontal plane with the submerged portion of a column is either constant or increases when the depth increases.

The prior art may be illustrated by the British patent application GA-A-2 110 602 which describes columns connected to a point by connecting pieces having a bell shaped form which are not submerged. These connection pieces only play a structural role. Since they are not submerged they do not participate in the hydraulic balancing of the platform. U.S. Pat. No. 1,879,745 also a floating support columns are surrounded by a tubular protective element having an upward diverging shape. This protective element is able to swing in all directions and to move vertically.

SUMMARY OF THE INVENTION

The present invention brings an improvement in balancing of sea platforms by using a sea platform having several columns which are wherein over at least a submerged portion of at least one column, a section defined by the intersection of this portion with a horizontal plane decreases when as the depth increases.

The present invention applies to a platform having at least two columns joined together by a pontoon.

This reduction of the section depending on the depth may be substantially linear, or vary in any other way more especially so as to accomodate structures situated on the lower part of the platform, such as pontoons. It is still within the scope of the present invention if the variable section portion is situated between two cylindrical portions.

The invention applies not only to a semi submersible platform but to a platform anchored to the sea bed by taut lines.

In an advantageous embodiment, the platform may comprise five columns with joined together by pontoons, each of the five columns comprising a submerged portion whose section decreases, for example, linearly, as a function of the depth.

The present invention is particularly well adapted to the construction of platforms comprising pontoons.

In the case of semi-submersible platforms, the present invention reduces the movements of these platforms in service.

Very high forces are generated in the anchorage lines of a platform with taut lines, constructed in accordance with the prior art, because of the action of the swell. In the case of a semi submersible platform, constructed according to the prior art, the action of the swell results in considerable movements of the platform. It is therefore advantageous to optimize the architecture of the shell so as to minimize the forces. By judiciously choosing the dimensions of the different parts of a platform, it is possible to at least partially counterbalance the overall or resultant forces for swells having certain periods. This technique, which is well known, is explained by the fact that the forces acting on the different parts are not all orientated in the same direction.

In the case of platforms anchored by taut lines, the present invention allows the forces exerted on these lines to be reduced in some cases and, consequently, the number and/or section thereof to be reduced.

The present invention will be better understood and its advantages will appear more clearly from the following description when taken in connection with the accompanying drawings which show, for the purposes of illustration only, several embodiments in accordance with the present invention, and wherein.

While the following description describes embodiments relating to a platform anchored by taut lines subjected to a swell, it is understood that the present invention is equally applicable to other types of platforms particularly to semi-submersible platforms with conventional anchorage or subjected to other forces than those of a swell such as, for example, currents and winds.

Figure 1:
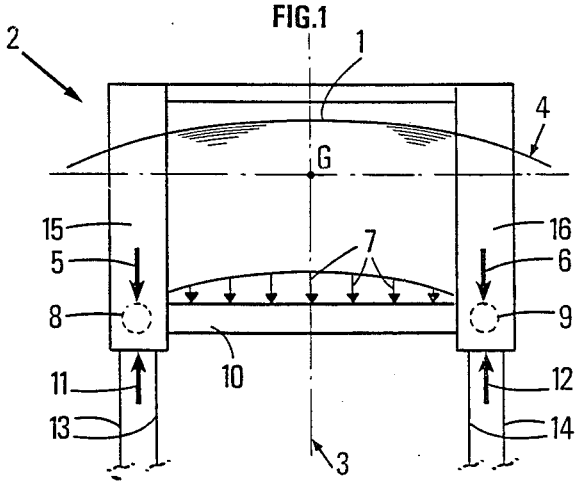
FIGS. 1 and 2 are schematic views of a rectangular platform subjected to a lateral swell at two different times.
Figure 2:
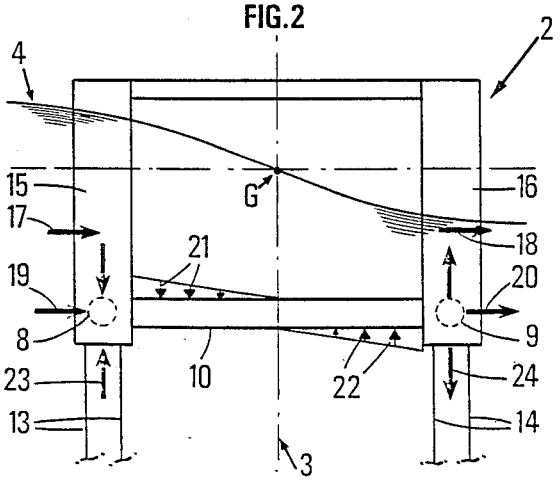

Referring now to the drawings wherein like reference numerals are used throughout the various views to designate like parts and, more particularly, to FIGS. 1 and 2, according to these figures, as a first approximation, it can be seen that when a crest 1 of a wave 4 is on an axis 3 of the platform, vertical forces 5, 6 and 7 exerted on all horizontal parts, 8, 9, 10 such as, for example, pontoons, are directed downwardly. On the other hand, the resultant of dynamic pressure forces at the base of the columns 15, 16 is directed upwardly and represented by the forces 11, 12, with the horizontal forces being cancelled out. A quarter of a cycle before or after this time, the vertical forces 21, 22 are cancelled out as shown most clearly in FIG. 2, but, on the other hand, the horizontal forces 17 to 20 and the moments about the center of gravity G become maximum.

Often it is these moments which generate the greatest forces in the anchorage lines 13 and 14. The moment generated by the dynamic pressure forces 23 and 24 at the base of columns 15 and 16 acts in a reverse direction to the other moments.

Figure 2A:
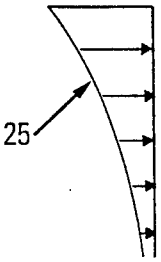
FIGS. 2A and 3A are schematic representations of a profile of dynamic pressures as a function of depth.

In both cases, by judiciously choosing the ratio of the column/pontoon diameters, the overall forces which cause fluctuations of tension in these lines 13 and 14 may be reduced. The dynamic pressure 25, due to the swell (see FIG. 2A) decreases with the depth. It is therefore difficult to counterbalance the forces especially for a swell of small period, for which this decrease as a function of the depth is particularly pronounced.

Figure 3A:
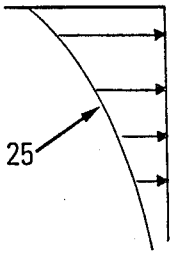
Figure 3B:
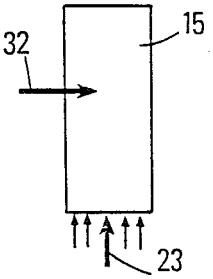
FIG. 3B is a schematic representation of a cylindrical column.
Figure 3C:
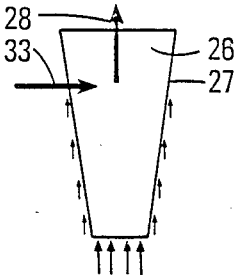

It has been discovered that this situation may be considerably improved by replacing cylindrical columns 15 (see FIG. 3B) on which the horizontal forces 32 are exerted, by columns whose section decreases when the depth increases, for example, by using truncated cone shaped columns 26 (see FIG. 3C).

The dynamic pressure 25 (see FIG. 3A) acting on the sloping walls 27 of the truncated cone shaped part of column 26 generates a considerable upwardly directed resultant force 28. For example, for a draft of 40 meters, the vertical force on a truncated cone shaped column 26 may exceed that which is exerted on a cylinder 15 of the same volume in a proportion corresponding to the following factors:

| SWELL PERIOD | 8 secs. | 12 secs. | 16 secs. |
|---|---|---|---|
| FACTOR | 19 secs. | 6.6 secs. | 4.6 secs. |

Figure 4:
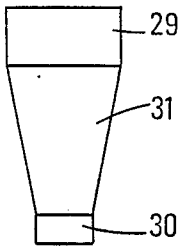
FIGS. 3C and 4 are schematic representations of truncated cone shape.

It can be seen that the factor is all the higher the shorter the period of the swell. A very large increase of vertical force 28 at a low period could be troublesome, especially if the natural period of the platform 2 under pounding conditions corresponds to that of the swell. It is possible to reduce such forces by giving to the top part of the column a cylindrical shape 29 with vertical walls (see FIG. 4). It is thus possible to counterbalance the overall forces exerted on a platform for several different swell periods.

A cylindrical shaped part 30 added to the lower end of the truncated cone shaped portion 31 with downwardly decreasing section may facilitate the construction.

Though the horizontal forces 33 (FIG. 3C) applied to truncated cone shaped columns are greater than those exerted on cylindrical columns 5 (FIG. 3B) of equal volume, the resultant moments about the center of gravity G (which is normally close to the free surface) are smaller since the lever arms are reduced.

Figure 5:
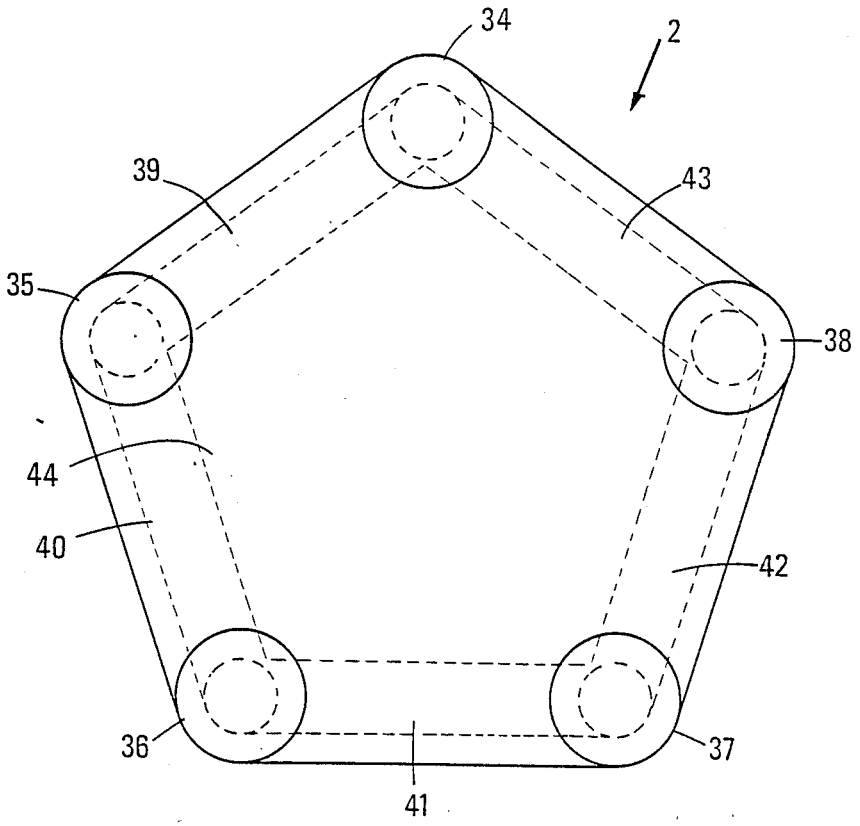
FIGS. 5 and 6 are schematic views of a platform with taut lines comprising five columns.
Figure 6:
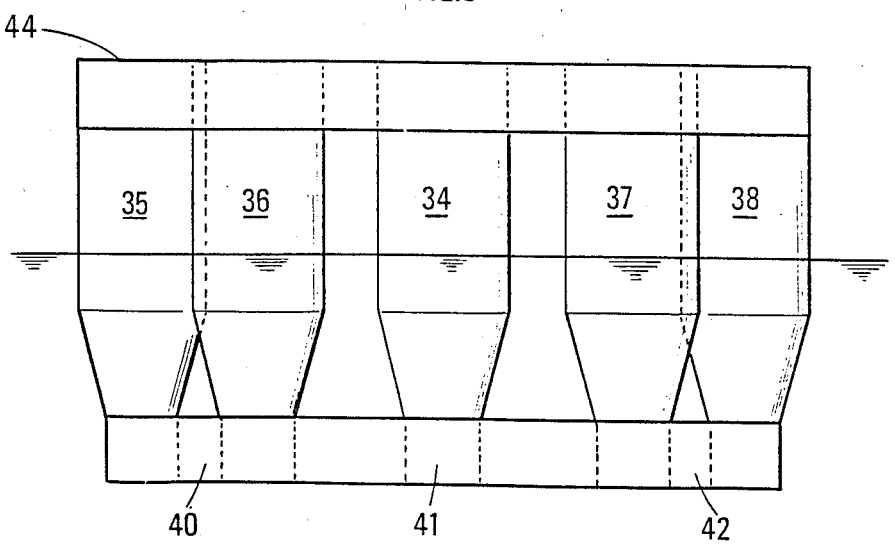

FIGS. 5 and 6 show a platform 2 with anchorage by means of taut lines comprising five columns 34 to 38 each of which has truncated cone shape.

The columns are joined together at their lower end by pontoons 39 to 43 and support a deck 44 at their upper part. The structure of this taut line platform, particularly the use of five columns, reduces very substantially the forces due to the swell exerted on the anchorage lines.

Of course, it is still within the scope of the present invention to give to the column or to a part of the column a shape different from the truncated cone shape while complying with the definition given above, whether this shape has an axis of revolution or not.

Moreover, this shape may be determined as a function of the profile of the forces acting on the platform and/or on the columns, particularly as a function of the profile of the dynamic pressures.

What is claimed is:

1. A sea platform which comprises several vertical columns, at least partially submerged in service and some of which are joined together at their lower ends by pontoon means and which support a deck at their upper portions, over at least one submerged portion of at least one vertical column the section defined by the intersection of this portion with a horizontal plane decreases when the depth increases to provide sloping walls on said one submerged portion; dynamic pressure forces acting on said sloping walls generating upwardly directed resultant forces so that fluctuations of forces and moments acting on the platform are reduced; the lower ends of said vertical columns having smaller cross-sections than the upper portions of said columns.

2. The platform as claimed in claim 1, wherein said section decreases with the depth in a substantially linear way.

3. The platform as claimed in claim 1, wherein said portion with section decreasing with the depth is situated between two cylindrical portions.

4. The platform as claimed in claim 2 or claim 3 wherein said platform is of the semi-submersible type.

5. The platform as claimed in claim 2 or claim 3, wherein said platform is anchored to the sea bed by taut lines.

6. The platform as claimed in claim 1 or claim 2, comprising five columns joined together by said pontoon means, wherein each of the five columns has a submerged portion with said section that decreases when the depth increases.

7. A sea platform which comprises a deck, a plurality of vertical support columns at least partially submerged in service and pontoon means submerged in service; the lower ends of said support columns being joined together by said pontoon means and upper portions of said columns supporting said deck; the submerged portion of each of said support columns having a tapered portion with a cross-section defined by the intersection of the submerged portion with a horizontal plane which decreases with an increase in depth to which the portion is submerged; said tapered portion extending over sufficient length of the column to reduce fluctuations of overall forces and moment generated by the dynamic pressure forces acting on columns and the pontoon means; the lower ends of said support columns having smaller cross-sections than the upper portions of said support columns.

8. A platform as claimed in claim 7, wherein said cross-section decreases with the depth in a substantially linear relationship.

9. A platform as claimed in claim 7, wherein said tapered portion with a cross-section decreasing with the depth is situated between two cylindrical portions.

10. A platform as claimed in claim 7, wherein said platform is of the semi-submersible type.

11. A platform as claimed in claim 7, wherein said platform is anchored to the sea bed by taut lines.

12. A platform as claimed in claim 11, wherein five columns are joined together by said pontoon means, each of said five columns having a submerged tapered portion with a cross-section which decreases with an increase in the depth to which the portion is submerged; said submerged portion of each of said columns further comprising one cylindrical portion located above the tapered portion and another cylindrical portion located below the tapered portion; the dynamic pressure forces acting on the tapered portions of said five columns generating upwardly directed resultant forces which reduce the tension forces exerted on said taut lines due to a swells at sea.

13. A sea platform comprising several columns at least partially submerged in service and some of which are joined together by pontoons, wherein, over at least one submerged portion of at least one column, the section defined by the intersection of this portion with a horizontal plane decreases with the depth of submersion in such a way that fluctuations of the overall forces and moments generated by the dynamic pressure induced forces acting on columns and pontoons are reduced; the lower portions of the several columns having smaller cross-sections than upper portions of said several columns.

14. The platform as claimed in claim 13, wherein lower ends of said several columns are joined together by the pontoons and said pontoons comprises horizontal pontoons which are rigidly fixed to said columns.

15. The platform as claimed in claim 13, further comprising a deck supported at upper ends of said columns.

16. A platform as claimed in claim 7, wherein said tapered portion of each of said support columns is directly connected to said pontoon means.

* * * * *